US005740728A

United States Patent [19]

DeBarber et al.

[11] Patent Number: 5,740,728

[45] Date of Patent: Apr. 21, 1998

[54] MAILING MACHINE

[75] Inventors: Christopher DeBarber, Woodbury; Gerald C. Freeman, Norwalk, both of Conn.

[73] Assignee: Pitney Bowes Inc., Stamford, Conn.

[21] Appl. No.: 717,788

[22] Filed: Sep. 23, 1996

[51] Int. Cl.[6] ..... B41L 47/46

[52] U.S. Cl. ..... 101/93; 271/198; 198/844.1; 400/635; 347/104; 101/91

[58] Field of Search ..... 101/91, 93, 232; 271/198, 199; 198/806, 807, 844.1, 846; 346/135.1, 139 A; 347/104, 105, 106; 400/635

[56] References Cited

U.S. PATENT DOCUMENTS

| | | | |
|---|---|---|---|
| 4,225,036 | 9/1980 | Michael | 198/840 |
| 4,484,903 | 11/1984 | Schneider | 474/242 |
| 4,557,372 | 12/1985 | Rajagopal | 198/807 |
| 4,957,199 | 9/1990 | Wokke et al. | 198/847 |
| 4,959,040 | 9/1990 | Gardner et al. | 474/103 |
| 5,136,307 | 8/1992 | Uchida et al. | 346/136 |
| 5,467,709 | 11/1995 | Salomon | 101/93 |
| 5,544,579 | 8/1996 | Gallagher et al. | 101/91 |

FOREIGN PATENT DOCUMENTS

| | | | |
|---|---|---|---|
| 0432604 B1 | 6/1994 | European Pat. Off. . | |
| 62-212640 | 9/1988 | Japan | 271/198 |
| 4-1253239 | 4/1992 | Japan | 271/198 |
| 5-221548 | 8/1993 | Japan | 271/198 |
| 6-144626 | 5/1994 | Japan | 271/198 |

*Primary Examiner*—Christopher A. Bennett
*Attorney, Agent, or Firm*—Angelo N. Chaclas; Melvin J. Scolnick

[57] ABSTRACT

A mailing machine comprising a control system, a print head having individual print elements which are selectively energizable for printing on an envelope and a transport system for feeding the envelope past the print head. The transport system including a first pulley, a second pulley in proximate location to the print head, an endless belt extending between the first and second pulley, the endless belt engaging the envelope and feeding the envelope past the print head, a drive system for causing the endless belt to rotate and an encoder system operatively coupled to the second pulley for providing signals indicative of the position of the second pulley. The control system in operative communication with the print head, the encoder system and the drive system for synchronizing the feeding of the envelope with energizing of the elements of the print head.

17 Claims, 4 Drawing Sheets

MAILING MACHINE

FIELD OF THE INVENTION

The present invention relates generally to a mailing machine. More particularly, the invention relates to a mailing machine having a transport apparatus for feeding envelopes in continuous stream fashion past a print head for printing a postal indicia thereon.

BACKGROUND OF THE INVENTION

Mailing machines are well known in the art. Generally, mailing machines are readily available from manufactures such as Pitney Bowes, Stamford, Conn. Mailing machines often include a variety of different modules which automate the processes of producing mailpieces. The typical mailing machine includes a variety of different modules or subsystems where each module performs a different task on a mailpiece, such as: singulating (separating the mailpieces one at a time from a stack of mailpieces), weighing, sealing (wetting and closing the glued flap of an envelope), applying evidence of postage, accounting for postage used, feeding roll tape or cut tape strips for printing and stacking finished mailpieces. However, the exact configuration of each mailing machine is particular to the needs of the user. Customarily, the mailing machine also includes a transport apparatus which feeds the mailpieces in a path of travel through the successive modules of the mailing machine.

To apply evidence of postage, it is typical in the industry to use a postage meter module or other suitable printer. Postage meters may utilize a variety of different technologies to perform the printing process. Traditional postage meters use a rotary die that includes an embossed or raised surface in the pattern of the postal indicia. After applying ink to the die, the die is rotated to engage an envelope and transfer the ink from the embossed surface to the envelope to form the postal indicia. Other postage meters and printers use thermal printing technology to create the postal indicia on the envelope. In thermal printers, the envelope is compressed against a thermal print head by a print or platen roller with a thermal ink ribbon captured there between. To print the postal indicia, the envelope and ink ribbon are simultaneously advanced past the thermal print head while the individual thermal print head elements are selectively heated causing the ink to liquefy and transfer to the envelope. Once printing is completed, it is necessary to feed the envelope from the postage meter.

Still other postage meters and printers use ink jet printing technology to create the postal indicia. In ink jet printers, the envelope is brought to within a predetermined distance of the print head so that a desire print gap is established. To print the postal indicia, the envelope is advanced past the ink jet print head while the individual print head elements, commonly referred to as nozzles, are selectively energized causing ink to be ejected from the print head and onto the envelope. Alternatively, the envelope could be held stationary while the print head traverses over the envelope as the nozzles are energized.

In both thermal and ink jet printing it is necessary to synchronize the feeding of the envelope with the operation of the print head so that a high quality printed image is obtained. If the actual speed of the envelope is slower than the desired speed, then the printed image will be distorted by being compressed. If the actual speed of the envelope is faster than the desired speed, then the printed image will be distorted by being elongated. If the actual speed of the envelope varies during the printing cycle, then the printed image may be distorted by both compressed and elongated portions. Thus, the speed of the envelope must be closely controlled throughout the printing cycle so that the energizing of the print head elements produces the desired image without any distortion.

To track the position and speed of the envelope many prior art systems employ a transport apparatus including a drive source and an encoder system coupled directly to the drive source. However, these prior art systems suffer from various disadvantages and problems. A first type of prior art transport apparatus includes a motor, an encoder system coupled directly the motor and a drive roller mounted to the output shaft of the motor. The transport apparatus is positioned with respect to the print head so that the drive roller is in opposing relationship to the print head elements. In this fashion, accurate encoding of the drive roller is ensured. Although this system generally works well, it creates packaging problems. Since the motor and print head are located in close proximity to each other, assuring adequate space for all the necessary components becomes difficult. Additionally, these types of systems are not well suited to mailing machines that must print over a wide print zone.

A second type of prior art transport apparatus includes a motor, an encoder system coupled directly to the motor and a feed system operatively coupled to the output shaft of the motor. The feed system generally employs a belt looped around a series of pulleys and a series of gears connecting the pulleys to the output shaft of the motor. In this transport apparatus, the motor is located remotely from the print head so that the packaging difficulties described above are alleviated. Additionally, the use of a belt allows for a longer transport path. However, this transport apparatus creates other problems. Because the encoder system is far removed from the print head, accurate tracking of the envelope is made difficult due to the accumulation of manufacturing tolerances and compliance of the components between the encoder system, the feed belt and the print head. Moreover, as the belt wears and stretches over time, the accuracy of the encoding will degrade further.

Therefore, there is a need for a transport apparatus which provides a long transport path, allows for flexibility in packaging and provides for accurate encoding over a wide print zone.

SUMMARY OF THE INVENTION

It is an object of the present invention to present a transport apparatus that substantially overcomes the disadvantages and problems associated with the prior art systems.

In accomplishing this and other objects there is provided a mailing machine comprising a control means, a print head having individual print elements which are selectively energizable for printing on an envelope and a transport means for feeding the envelope past the print head. The transport means including a first pulley, a second pulley in proximate location to the print head, an endless belt extending between the first and second pulley, the endless belt engaging the envelope and feeding the envelope past the print head, drive means for causing the endless belt to rotate and encoder means operatively coupled to the second pulley for providing signals indicative of the position of the second pulley. The control means is operative communication with the print head, the encoder means and the drive means for synchronizing the feeding of the envelope with energizing of the elements of the print head.

Additional objects and advantages of the invention will be set forth in the description which follows, and in part will be obvious to those skilled in the art from the description, or may be learned by practice of the invention.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
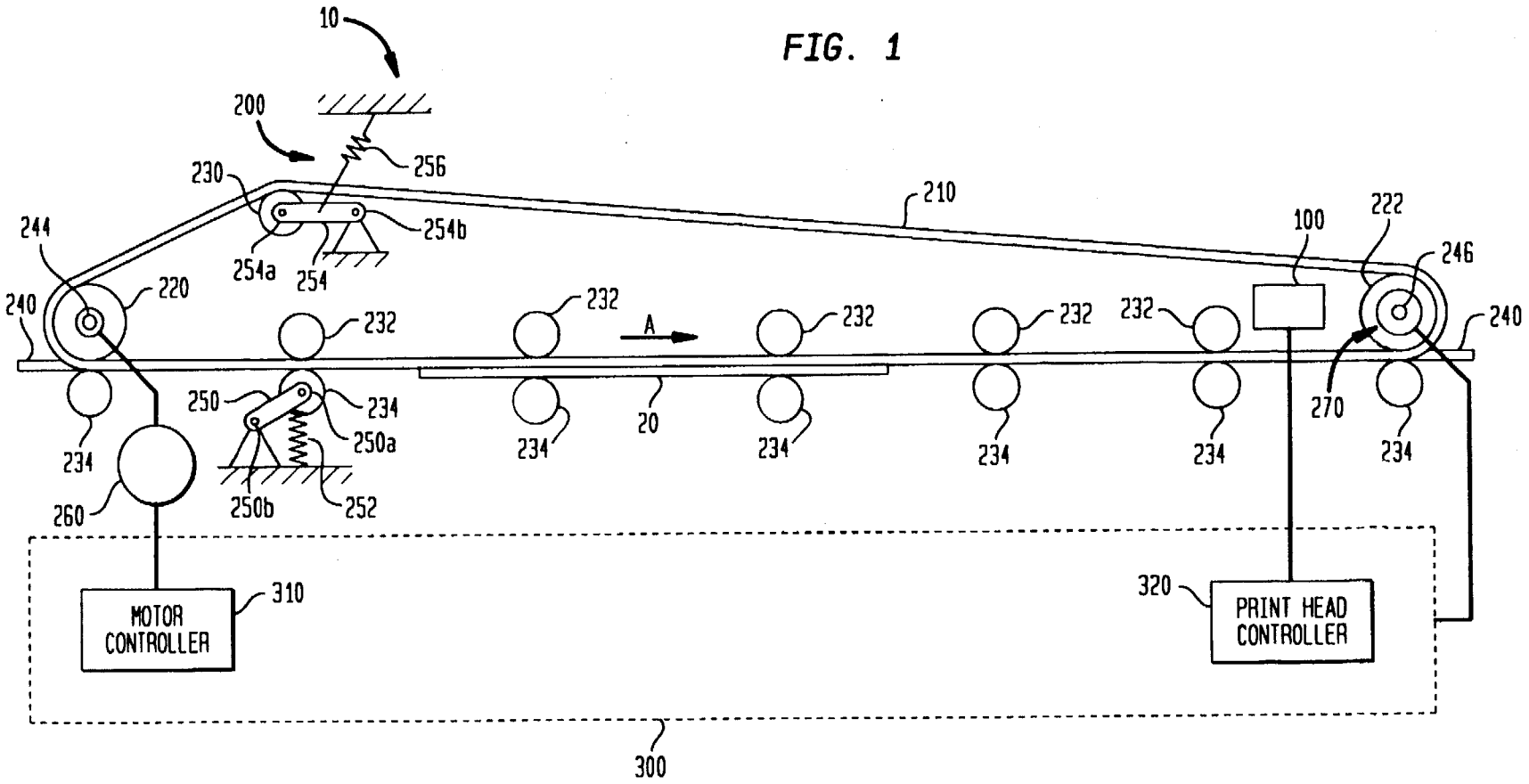
FIG. 1 is a schematic representation of an elevational view of a partial mailing machine including a transport apparatus in accordance with the invention.

Referring to FIG. 1, a mailing machine 10 including a print head module 100, a transport apparatus 200 and a micro control system 300 is shown. The transport apparatus 200 feeds envelopes in a seriatim fashion in a path of travel along a deck 240 as indicated by arrow A past the print head module 100 so that an indicia of postage can be printed on each envelope 20. The print head module 100 is of an ink jet print head type having a plurality of ink jet nozzles (not shown) for ejecting droplets of ink in response to appropriate signals. The print head module 100 may be of any conventional type such as those commonly available from Hewlett-Packard Company and Canon Inc.

The transport apparatus 200 includes an endless belt 210 looped around a drive pulley 220 and an encoder pulley 222 which is located downstream in the path of travel from the drive pulley 220 and proximate to the print head module 100. The drive pulley 220 and the encoder pulley 222 are substantially identical and are fixably mounted to shafts 244 and 246, respectively, which are in turn rotatively mounted to any suitable structure (not shown) such as a frame. The shaft 244 is operatively connected to a motor 260 by any conventional means such as intermeshing gears (not shown) or a timing belt (not shown) so that when the motor 260 rotates in response to signals from the micro control system 300, the drive pulley 220 also rotates which in turn causes the endless belt 210 to rotate and advance the envelope 20 along the path of travel.

The transport apparatus 200 further includes a plurality of idler pulleys 232, a plurality of normal force rollers 234 and a tensioner pulley 230. The tensioner pulley 230 is initially spring biased and then locked in place by any conventional manner such as a set screw and bracket (not shown). This allows for constant and uniform tension on the endless belt 210. In this manner, the endless belt 210 will not slip on the drive pulley 220 when the motor 260 is energized and caused to rotate. The tensioner pulley 230 is rotatively mounted to one end 254*a* of an arm 254 while the other end 254*b* of the arm 254 is pivotally mounted to any suitable structure (not shown). An extension spring 256 is fixed at one end while the other end is mounted along the span of the arm 254 so as to bias the tensioner pulley 230 outward against the tensioner pulley 230. The idler pulleys 232 are rotatively mounted to any suitable structure (not shown) along the path of travel between the drive pulley 220 and the encoder pulley 222. The normal force rollers 234 are located in opposed relationship and biased toward the idler pulleys 232, the drive pulley 220 and the encoder pulley 222, respectively. Each normal force roller 234 is rotatively mounted to one end 250*a* of an arm 250 while the other end of the arm 254 is pivotally mounted to any suitable structure (not shown). For the sake of simplicity, a suitable mounting arrangement is only shown with respect to one of the normal force rollers 234. A compression spring 252 is fixed at one end while the other end is mounted along the span of the arm 250 so as to bias the normal force roller 234 upward and into contact with the endless belt 210.

As described above, the normal force rollers 234 work to bias the envelope 20 is up against the deck 240. This is commonly referred to as top surface registration which is beneficial for ink jet printing. Any variation in thickness of the envelope 20 is taken up by the deflection of the normal force rollers 234. Thus, a constant gap (the distance between the print head module 100 and the deck 240) is set between the envelope 20 and the print head module 100 no matter what the thickness of the envelope 20. The constant gap is optimally set to a desired value to achieve quality printing. It is important to note that the deck 240 contains suitable openings for the endless belt 210 and normal force rollers 234.

Figure 1A:
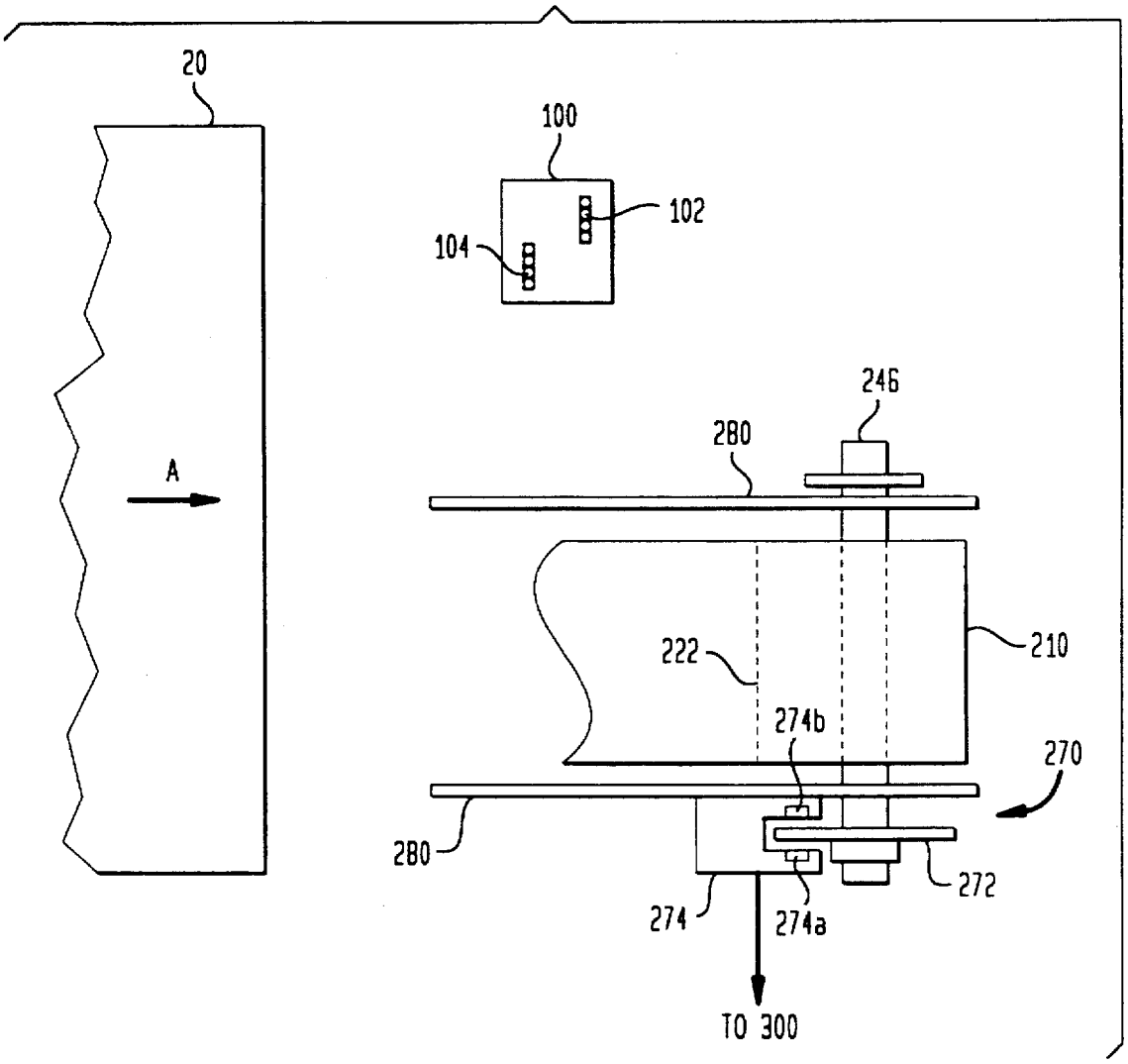
FIG. 1A is a schematic representation of a plan view of an encoder pulley and an encoder system in accordance with the invention.

Referring to FIGS. 1 and 1A, the transport apparatus 200 also includes an encoder system 270 which is located proximate to the print head module 100 and operatively coupled to the encoder pulley 222. The encoder system 270 includes an encoder disk 272 fixably mount to the shaft 246 and an encoder detector 274 fixably mounted to a frame 280. Thus, as the encoder pulley 222 rotates so does the encoder disk 272. The encoder disk 272 has a plurality of vanes located around its circumference and is of a conventional type, such as model number HP 5100 available from Hewlett-Packard Company. The encoder detector 274 is also of the conventional type, such as model number HP 9100 available from Hewlett-Packard Company, and includes a light source 274*a* and a light detector 274*b*. The encoder disk 272 and the encoder detector 274 are positioned with respect to each other so that the vanes of the encoder disk 272 alternately block and unblock the light source 274*a* as the shaft 246 rotates. The transition from blocked to unblocked or vice versa results in a change of state (also commonly referred to as a "count") for the encoder detector 274. The encoder disk 272 has been selected so that 1024 counts occur per revolution. In this manner, the position and speed of the shaft 246 can be tracked. This type of encoder system 270 is well known and those skilled in the art will recognize other means for encoding which would serve equally well.

In the preferred embodiment, the print head module 100 includes a first row of nozzles 102 and a second row of nozzles 104 which may correspond to individual print heads which have been assembled together to form the print head module 100. Generally, the distance between the first row of nozzles 102 and the second row of nozzles 104 measured along the path of travel is necessary for packaging and performance considerations. Typically, high performance print head capable of high resolution printing at high speeds are only available in linear arrays of small length. Thus, to print a wide swath across the envelope 20 requires the alignment of multiple print heads in end to end fashion as measured in a direction transverse to the path of travel. The use of multiple print heads in this fashion increases the print zone over which accurate encoding needs to take place because encoding must now occur over the print area plus the distance between the print heads. Those skilled in the art will recognize that any number of print heads can be arranged in this or analogous manners to achieve a desired print quality and speed. However, it is important to note that it is possible for the print head module 100 to only include a single row of nozzles if print quality and/or print speed are reduced or height of print requirement.

The transport apparatus 200 and the print head module 100 as described above are under the control of the micro control system 300 which may be of any suitable combination of microprocessors, firmware and software. The micro control system 300 includes a motor controller 310 which is in operative communication with the motor 260 and a print head controller 320 which is in operative communication with the print head module 100. Additionally, the micro control system 300 is in operative communication with the encoder system 270 via the encoder detector 274. The micro control system 300 constantly compares the actual position of the envelope 20 with the desired position of the envelope 20 and computes appropriate corrective drive signals which are communicated to the motor controller 310. The motor controller 310 then provides energizing signals to the motor 260 in response to the drive signals received from the micro control system 300.

The print head controller 320 provides energizing signals to the nozzles 102 and 104 of the print head module 100 in response to instructions from the micro control system 300. As an input, the micro control system 300 receives the counts from the encoder detector 274 as the encoder disk 272 alternately blocks and unblocks the encoder detector 274. At each count, the micro control system 300 instructs the print head controller 320 to energize the nozzles 102 and 104, appropriately. Thus, a line of print occurs for each count that takes place during printing.

Figure 2:
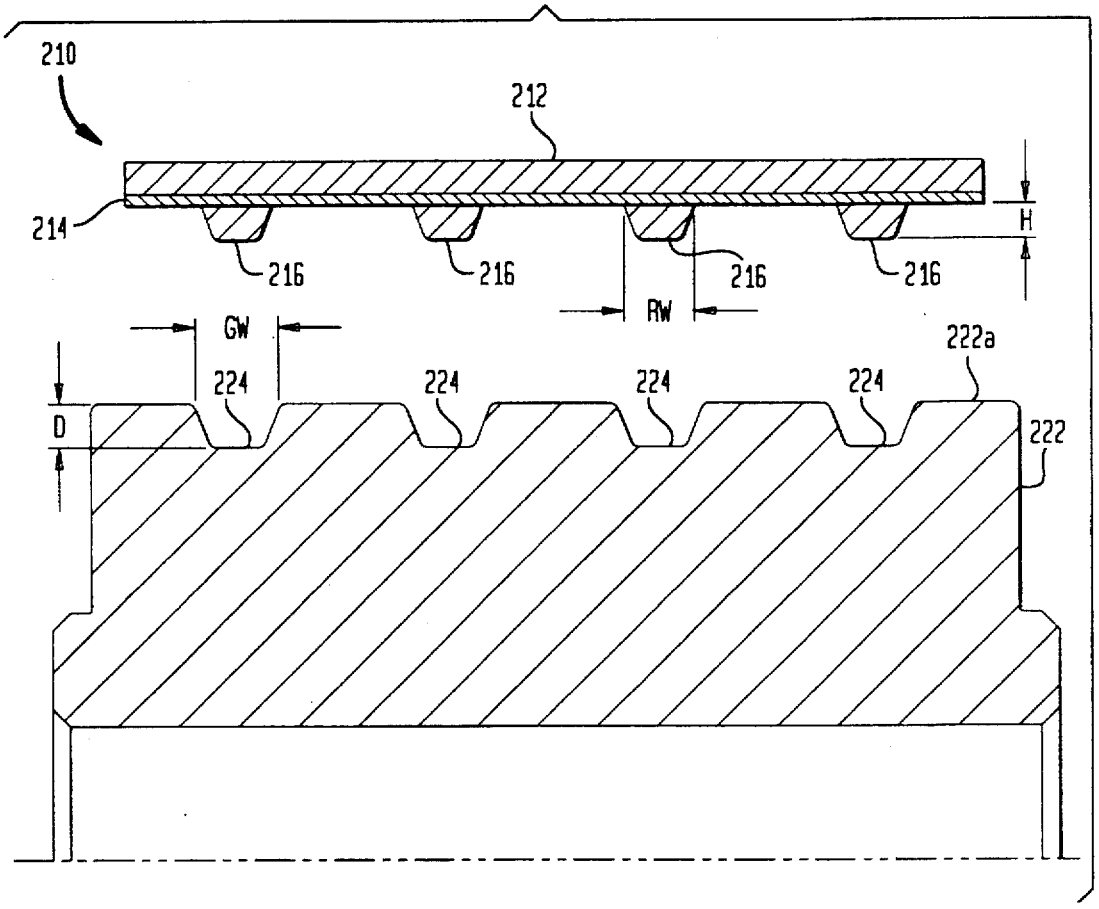
FIG. 2 is a schematic representation of a cross sectional exploded end view of a belt and a pulley in accordance with the invention.

Referring to FIG. 2, the endless belt 210 and the encoder pulley 222 are shown in more detail in a cross sectional end view in spaced apart relationship for clarity. The endless belt 210 includes an outer layer or main body 212, an inner layer comprised of a reinforcing cord 214 and a plurality of ribs 216 which extend outward from the reinforcing cord 214 a predetermined height H. The ribs 216 have a predetermined width RH at their root. Because the main body 212 is in contact with the envelope 20, it is made of a material such as polyurethane having a durometer of 35–70 to produce a suitably high coefficient of friction. This ensures no slippage between the endless belt 210 and the envelope 20. The reinforcing cord 214 serves to keep the endless belt 210 dimensionally stable by preventing the endless belt 210 from stretching. It may be made from any suitably strong material (high modulus of elasticity—to reduce stretch) which is also flexible enough to withstand repeated bending and tensile forces. For example, Kevlar®, which is readily available from Dupont, or metal fiber. The ribs 216 of the endless belt 210 fit into a plurality of corresponding grooves 224 of a predetermined depth D from the outside diameter 222*a* of the encoder pulley 222. The grooves 224 have a predetermined with GW at their opening. Those skilled in the art will recognize that the drive pulley 220 and the idler pulleys 232 must also have grooves to accommodate the ribs 216 of the endless belt 210.

Figure 3:
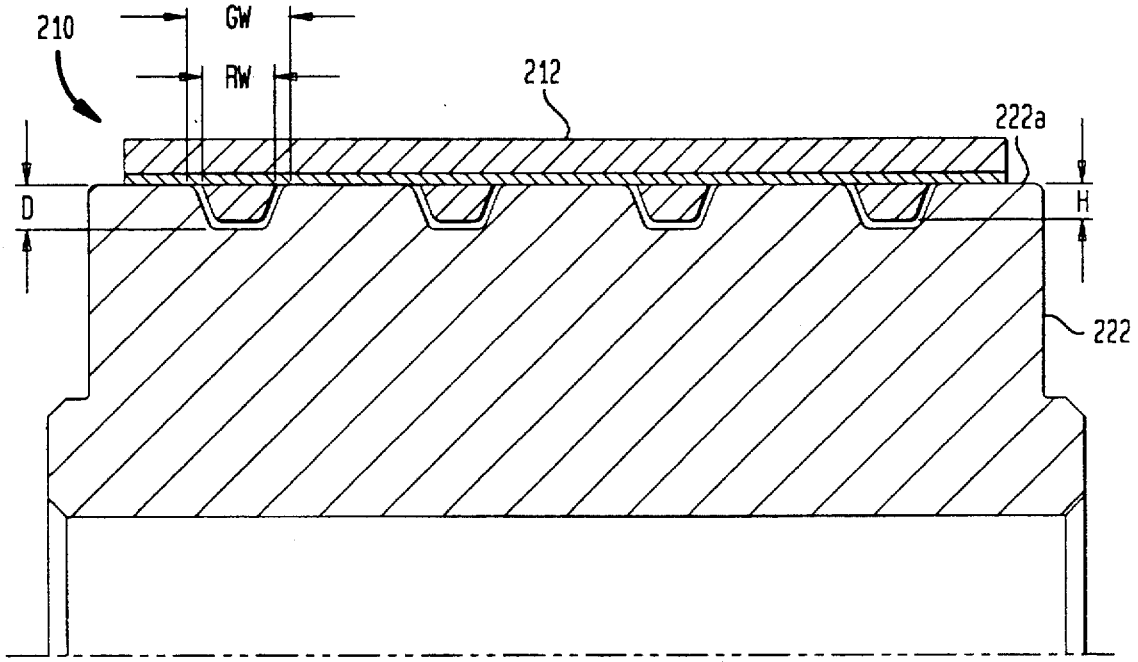
FIG. 3 is a schematic representation of a cross sectional assembled end view of the belt and the pulley of FIG. 2 in accordance with the invention.

Referring to FIG. 3, the endless belt 210 and the encoder pulley 222 are shown in more detail in a cross sectional end view in their assembled positions. Referring to FIGS. 2 and 3, it is important to note that the height H of the ribs 216 is established to be less than the depth D of the grooves 224. This will ensure that the ribs 216 will not bottom out on the grooves 224 and cause the endless belt 210 to lift off from the encoder pulley 222. Thus, the reinforcing cord 214 of the endless belt 210 remains in intimate bearing contact with the outer diameter 222*a* of the encoder pulley 222. Thus, the endless belt 210 and the encoder pulley 222 are in driving engagement at the interface between the reinforcing cord 214 and the outer diameter 222*a*. Additionally, those skilled in the art will recognize that this arrangement provides for a constant pitch radius for the endless belt 210 as opposed to traditional V-type belts which sink further into their pulleys resulting in a shrinking pitch radius as the ribs wear. The pitch radius, which is dependent upon the radius of the encoder pulley 222 and the thickness of the belt 210, is set to 0.679 inches. Furthermore, it is desirable to design the groove width GW and the rib width RW to be as close as practicable. In this manner, lateral displacement of the endless belt 210 along the axis of the encoder pulley 222 will be reduced allowing for more accurate encoding.

With the structure of the mailing machine 10 described as above, the operational characteristics will now be described with reference to FIGS. 1, 1 A, 2 and 3. The micro control system 300 sends appropriate motor signals the motor 260 via the motor controller 310 to cause the motor 260 to rotate which in turn causes the endless belt 210 to rotate and advance the envelope 20. Generally, the speed and/or position of the envelope 20 is set to a predetermined desire value such as the highest rate of feeding which would still produce a quality postal indicia. Simultaneously, the micro control system 300 sends appropriate print signals to the print head module 100 via the print head controller 320 to cause the nozzles 102 and 104 to eject ink in a predetermined sequence at each encoder count to produce the postal indicia on the envelope 20. To determine how close the actual belt speed/position is to the predetermined belt speed/position, the micro control system 300 monitors the encoder signals from the encoder detector 274 and compares these signals to their expected signals. If the actual encoder signals do not match the expected encoder signals. Then the envelope 20 is not feeding at the predetermined speed and the risk of a distorted postal indicia is present. At this point, if the actual encoder signals match the expected encoder signals, then the micro control system 300 continues to operate in normal fashion. However, if the actual encoder signals do not match the expected encoder signals, then the micro control system 300 may take one of two, or a combination of both, corrective actions. First, the micro control system 300 may adjust the motor signals so as to bring the bring the endless belt 210 into conformance with the predetermined belt speed. Second, the motor controller 310 may adjust the print signals to account for the variance in the belt speed thus delaying or advancing the timing of the energizing of the print nozzles 102 and 104.

In the preferred embodiment, the micro control system 300 only need take the first corrective action. Because printing is directly coupled to the actual position of the envelope 20 via the encoder counts, no correction is needed to produce the postal indicia without distortion. Thus, even if the envelope 20 is not being fed at the correct speed, or experiences wide variations in speed or position over the desired speed or position, a quality print will still result. This is because the sequence of the energizing of the nozzles 102 and 104 is tied to the actual position of the envelope 20 via the encoder counts.

The combination of the pitch radius designed to be 0.679 inches coupled with the encoder disk having 1024 vanes per revolution yields a desired print density of approximately 240 dots per inch (DPI). This results from the fact that for every encoder count, the envelope 20 will travel approximately 0.0041 inches (easily derived from basic geometric principles). Thus, there is a distance of approximately 0.0041 inches between each line of print. Those skilled in the art will appreciate that by varying the system geometry and the encoder disk different print densities may be obtained.

Many features of the preferred embodiment represent design choices selected to best exploit the inventive concept as implemented in a mailing machine with a long transport path. For example, encoding the operation of the belt 210 allows for more accurate encoding of longer print zones than with a single drive roller as described in the background of the invention. As another example, locating the encoder system 270 with the encoder pulley 222 provides for more accurate encoding than if the encoder system 270 was placed with the drive pulley 220 because of the reduced risk of slippage. Moreover, additional advantages than those described above and various modifications will readily occur to those skilled in the art. Therefore, the inventive concept in its broader aspects is not limited to the specific details of the preferred embodiment but is defined by the appended claims and their equivalents.

What is claimed is:

1. A mailing machine comprising:

a print head module having individual print elements which are selectively energizable for printing on an envelope;

a transport means for feeding the envelope past the print head, the transport means including:

a pulley shaft rotatively mounted to a frame;

a pulley in proximate location to the print head module fixably mounted to the pulley shaft;

an endless belt extending around and in driving engagement with the pulley, the endless belt engaging the envelope and feeding the envelope past the print head module;

drive means for causing the endless belt to rotate; and encoder means operatively coupled to the pulley shaft for providing signals indicative of the position of the pulley;

and control means in operative communication with the print head module, the encoder means and the drive means for synchronizing the feeding of the envelope with energizing of the elements of the print head module in response to the encoder signals.

2. The mailing machine of claim 1, wherein:

the endless belt includes an outer layer which is in contact with the envelope and an inner layer which is in contact with the pulley, the outer made from a first material and the inner layer made from a second material.

3. The mailing machine of claim 2, wherein:

the first material has a suitable coefficient of friction so as to prevent slippage between the envelope and the outer layer of the endless belt, and the second material has a suitable modulus of elasticity so as to prevent stretch of the endless belt.

4. The mailing machine of claim 3, wherein:

the endless belt further includes a rib projecting outward from the inner layer; and the pulley includes a groove adapted to receive the rib so as to prevent lateral displacement of the endless belt along the axis of the pulley.

5. The mailing machine of claim 4, wherein:

the rib of the endless belt has a predetermined height; and the groove of the pulley has a predetermined depth which is greater than the predetermined height of the rib.

6. The mailing machine of claim 5, wherein:

the pulley has an outer diameter; and the inner layer of the endless belt is in driving engagement with the outer diameter of the pulley.

7. The mailing machine of claim 2, wherein:

the pulley has an outer diameter; and the inner layer of the endless belt is in driving engagement with the outer diameter of the pulley.

8. The mailing machine of claim 7, wherein:

the first material has a suitable coefficient of friction so as to prevent slippage between the envelope and the outer layer of the endless belt, and the second material has a suitable modulus of elasticity so as to prevent stretch of the endless belt.

9. The mailing machine of claim 8, wherein:

the endless belt further includes a rib projecting outward from the inner layer; and the pulley includes a groove adapted to receive the rib so as to prevent lateral displacement of the endless belt along the axis of the pulley.

10. The mailing machine of claim 9, wherein:

the rib of the endless belt has a predetermined height; and the groove of the pulley has a predetermined depth which is greater than the predetermined height of the rib.

11. The mailing machine of claim 1, wherein:

the encoder means produces an encoder count at predetermined intervals corresponding to the angular rotation of the pulley shaft; and the control means energizes the print head module in relation to each encoder count during a print cycle.

12. The mailing machine of claim 11, wherein:

the control means energizes the print head module for each encoder count during the print cycle.

13. The mailing machine of claim 12, wherein:

the encoder means produces a predetermined number of encoder counts per revolution; and the pulley has a predetermined radius and the belt has a predetermined thickness which are selected so that in cooperation with the predetermined number of encoder counts the print head module produces an image having a desired print density of at least 240 dots per inch.

14. The mailing machine of claim 13, wherein:

the pulley has an outer diameter; and the inner layer of the endless belt is in driving engagement with the outer diameter of the pulley.

15. The mailing machine of claim 14, wherein:

the first material has a suitable coefficient of friction so as to prevent slippage between the envelope and the outer layer of the endless belt, and the second material has a suitable modulus of elasticity so as to prevent stretch of the endless belt.

16. The mailing machine of claim 15, wherein:

the endless belt further includes a rib projecting outward from the inner layer; and the pulley includes a groove adapted to receive the rib so as to prevent lateral displacement of the endless belt along the axis of the pulley.

17. The mailing machine of claim 16, wherein:

the rib of the endless belt has a predetermined height; and the groove of the pulley has a predetermined depth which is greater than the predetermined height of the rib.

* * * * *